US006585171B1

(12) United States Patent
Boecking

(10) Patent No.: US 6,585,171 B1
(45) Date of Patent: Jul. 1, 2003

(54) FUEL INJECTION VALVE

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/787,976

(22) PCT Filed: Mar. 23, 1999

(86) PCT No.: PCT/DE99/00839

§ 371 (c)(1),
(2), (4) Date: Jun. 26, 2001

(87) PCT Pub. No.: WO00/17507

PCT Pub. Date: Mar. 30, 2000

(30) Foreign Application Priority Data

Sep. 23, 1998 (DE) ..... 198 43 570

(51) Int. Cl.[7] ..... B05B 1/08

(52) U.S. Cl. ..... 239/102.1; 239/533.2; 251/129.06; 310/327

(58) Field of Search ..... 239/102.1, 102.2, 239/533.2, 533.12, 584, 88–92; 123/498; 251/129.06; 310/326, 327

(56) References Cited

U.S. PATENT DOCUMENTS 4,728,074 A * 3/1988 Igashira et al. ..... 239/584
4,803,393 A 2/1989 Takahashi
5,697,554 A 12/1997 Auwaerter et al.

FOREIGN PATENT DOCUMENTS

| | | | |
|---|---|---|---|
| DE | 43 06 073 | | 6/1994 |
| DE | 195 00 706 | | 7/1996 |
| DE | 195 34 445 | | 3/1997 |
| DE | 196 50 900 | | 6/1998 |
| EP | WO 94/19598 | * | 9/1994 |
| EP | 0 790 402 | | 8/1997 |
| JP | 61 283 760 | | 12/1986 |

* cited by examiner

*Primary Examiner*—Michael Mar
*Assistant Examiner*—Dinh Q. Nguyen
(74) *Attorney, Agent, or Firm*—Kenyon & Kenyon

(57) ABSTRACT

A fuel injector, in particular an injector for fuel injection systems in internal combustion engines, has a piezoelectric or magnetostrictive actuator. The actuator operates a valve closing body by means of a valve needle, working together with a valve seat face to from a sealing seat. A fuel line leads from a fuel inlet connection to the sealing seat. A fuel line leads from a fuel inlet connection to the sealing seat. The actuator is tubular and surrounds at least some sections of the fuel line.

13 Claims, 2 Drawing Sheets

FUEL INJECTION VALVE

FIELD OF THE INVENTION

The present invention relates to a fuel injector.

BACKGROUND INFORMATION

A fuel injector for a fuel injection system of an internal combustion engine having a piezoelectric actuator is described in German Published Patent Application No. 195 34 445. In addition, the valve has a valve closing body that can be operated by a one-piece valve needle and works together with a valve seat face to form a sealing seat. Fuel is supplied to the valve through a fuel inlet connection, with a fuel line leading to the sealing seat. The actuator is tubular in design, and the valve needle extends through the tubular actuator. The valve needle has an axial longitudinal opening, so that the valve needle forms a section of the fuel line which is thus surrounded by the actuator at least in some sections.

A fuel injector is described in German Published Patent Application No. 19500706. In the fuel injector described in this publication, a valve closing body together with a valve seat face forms a sealing seat. The fuel injector is designed either as an outward opening fuel injector or an inward opening fuel injector. The valve closing body is connected in one piece to a valve needle which can be operated by a piezoelectric actuator. Piezoelectric actuators have a relatively small operating stroke. It is therefore proposed in this publication that a hydraulic step-up device be arranged between the piezoelectric actuator and the valve needle to increase the actuator's operating stroke.

One disadvantage of these known fuel injectors is their relatively complicated design which has not been optimized for compactness. Another disadvantage is that the special hydraulic medium used for the hydraulic step-up device evaporates over a period of time due to leakage losses, which can have a negative effect on the lifetime and operation of this fuel injector.

A fuel injector having a piezoelectric actuator in another design is described in German Patent No. 43 06 073. However, this design is also not very compact, and it requires a relatively large space for installation. With the fuel injector derived from this publication, a hydraulic step-up device is again provided to transform the relatively small stroke of the piezoelectric actuator to a larger stroke of the valve needle. A special pressurized accumulator, e.g., in the form of an external pressure reservoir, is used to compress the hydraulic medium of the step-up device and to compensate for leakage losses. This requires an additional connection for this pressure reservoir or other measures to implement the accumulator.

Fuel injectors having piezoelectric actuators as known in the past were used mainly to inject fuel into a self-igniting internal combustion engine, in particular for injecting diesel fuel. The operating pressures occurring in this case are relatively high and have so far prevented a more compact, space-saving design.

SUMMARY OF THE INVENTION

The fuel injector according to the present invention has the advantage over the related art that it has an extremely compact design due to the fact that the fuel line passes through the tubular actuator. With the known fuel injectors, fuel passes by the actuator at the side, resulting in a wider design, or is supplied downstream from the actuator, which is usually unfavorable for the connection of the fuel line; however, the design according to the present invention yields a centrally guided fuel line with the possibility of providing the fuel inlet connection on the end of the fuel injector opposite the valve closing body. The housing may be designed with a relatively thinner wall, because the fuel line need not pass by the side of the actuator as in the related art.

The compact design also results in a short intake path for fuel, thus preventing cavitation problems.

In an advantageous manner, the valve needle extends through the tubular actuator, a longitudinal axial opening through the valve needle forming a section of the fuel line. The valve needle assumes the function of operating the valve closing body as well as the function of the fuel line.

It is especially advantageous to design the valve needle in two parts connected by a weld or a coupling piece. In this way, a valve needle section on the spray end can be inserted into the fuel injector on the spray end, and a valve needle section on the inlet end can be inserted into the fuel injector on the inlet end, with the two valve needle sections being joined subsequently. A flange providing support for a restoring spring may be premounted on the valve needle section on the inlet end.

The actuator is preferably surrounded radially by a prestress element. In comparison with the axial arrangement of the prestress element which is customary in the related art, this measure results in a more compact design.

It is especially advantageous to use fuel passing through the fuel line as the hydraulic medium for the step-up device. Then a special hydraulic medium such as oil is not needed for the step-up device. Any leakage losses are compensated by an automatic refilling operation. In addition, there is no risk of contamination of the fuel with a different type of hydraulic medium such as hydraulic oil.

DETAILED DESCRIPTION

Figure 1:
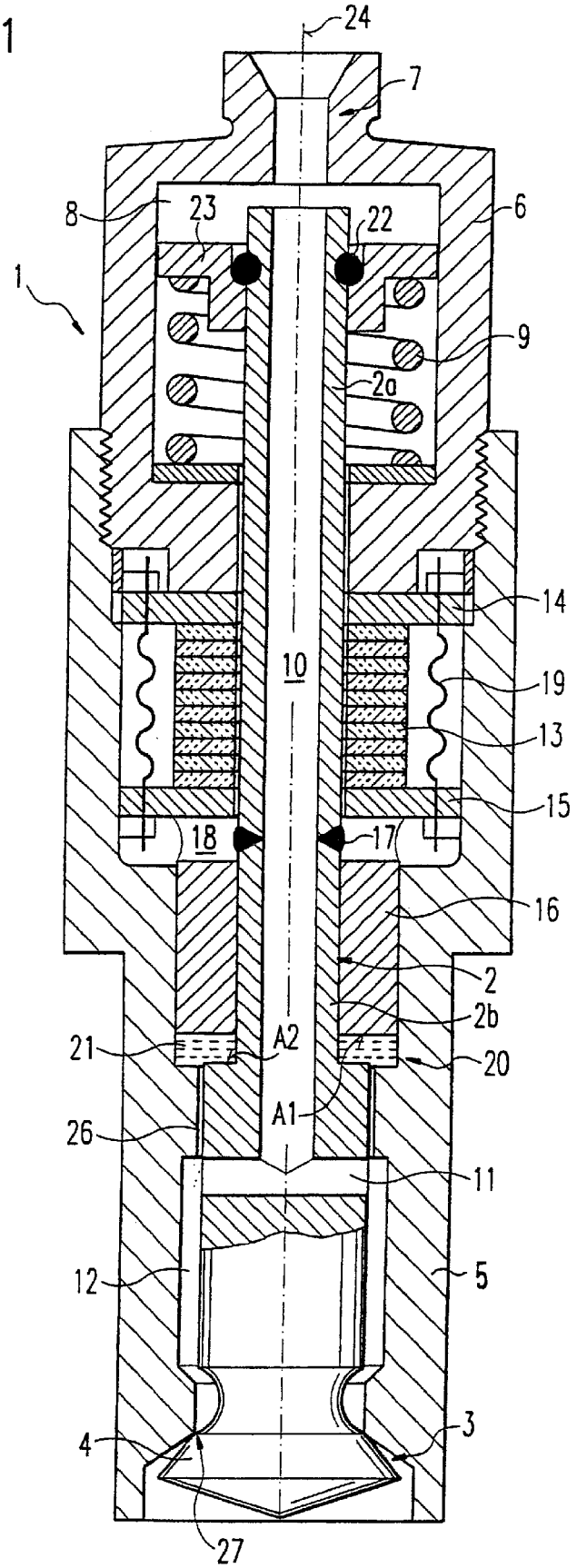
FIG. 1 shows an axial section through a first embodiment of a fuel injector according to the present invention.

FIG. 1 shows an axial section of a fuel injector 1 according to the present invention. Fuel injector 1 is used in particular for direct injection of fuel, gasoline in particular, into the combustion chamber of an internal combustion engine having spark ignition and mixture compression known as a direct gasoline injector. However, fuel injector 1 according to the present invention is also suitable for other applications.

Fuel injector 1 has a valve closing body 3 operable by a valve needle 2, which is divided into a valve needle section 2*a* on the inlet end and a valve needle section 2*b* on the spray end. In this embodiment, valve closing body 3 is designed in one piece with valve needle section 2*b* on the spray end. Fuel injector 1 illustrated in FIG. 1 is an outward opening fuel injector 1. Valve closing body 3 has a section 4 in the form of a truncated cone widening in the spray direction. Valve closing body 3 works together with a valve seat face 27 provided on a first housing body 5 to form a sealing seat.

Fuel is supplied through a fuel inlet connection 7 formed in a second housing body 6. Fuel flows through a chamber 8, which is provided in second housing body 6 to accommodate a restoring spring 9, and into tubular valve needle section 2*a* on the inlet end. Valve needle section 2*a* on the inlet end and valve needle section 2*b* on the spray end each have a longitudinal opening 10, longitudinal opening 10 extending over the entire axial longitudinal extent of valve needle section 2*a* on the inlet end but extending axially only over a section of valve needle section 2*b* on the spray end. Longitudinal opening 10 is connected to a radial bore 11 connecting longitudinal opening 10 to a recess 12 in first housing body 5. Valve needle 2 therefore forms a section of a fuel line leading from fuel inlet connection 7 to the sealing seat formed by valve closing body 3 and valve seat face 27. Fuel flows in recess 12 from radial bore 11 of valve needle 2 to the sealing seat formed by valve closing body 3 and valve seat face 27, where it is sprayed out when fuel injector 1 is operated.

A tubular actuator 13 according to the present invention is used to operate fuel injector 1. Actuator 13 surrounds valve needle section 2*a* on the inlet end and thus also surrounds a section of the fuel line passing through valve needle 2. Tubular actuator 13 is composed of a plurality of stacked piezoelectric ceramic plates, each provided with electrodes so that an electric voltage can be applied to the individual ceramic plates of actuator 13. Actuator 13 expands when acted upon by an electric voltage. Actuator 13 then abuts against second housing body 6 via a first flange 14 and acts on a step-up plunger 16 via a second flange 15. Valve needle section 2*a* on the inlet end and valve needle section 2*b* on the spray end are joined by a weld 17 in this embodiment. For weld 17 to be accessible to a welding tool during assembly, step-up plunger 16 has a plurality of radial bores 18 distributed around the circumference.

Actuator 13 is surrounded radially by a prestress element 19, which in this embodiment is designed as a corrugated tension spring belt. Prestress element 19 is clamped between a first flange 14 and a second flange 15 and creates an axial prestress for actuator 13.

When actuator 13 is operated, it expands and displaces step-up plunger 16 downward in FIG. 1 in the direction of valve closing body 3 via second flange 15. Step-up plunger 16 and valve needle 2 work together via a step-up device 20. Step-up device 20 is composed of a step-up chamber 21 filled with a hydraulic medium, step-up plunger 16 bordering on it with a first face A1 and valve needle 2 bordering on it with a second face A2. Second face A2 of valve needle 2 is smaller than first face A1 of step-up plunger 16. Therefore, the hydraulic medium displaced by the displacement of step-up plunger 16 results in displacement of valve needle 2 in the direction of valve closing body 3, i.e., downward in FIG. 1, with the stroke of valve needle 2 being greater than the operating stroke of step-up plunger 16 because of the ratio of areas of faces A1 and A2. A satisfactory valve stroke can be achieved in this way. After turning off the electric voltage which operates actuator 13, actuator 13 contracts again, i.e., is compressed by prestress element 19. Therefore, valve needle 2 is not acted upon further by an actuating force acting in the opening direction, and restoring spring 9 secured between second housing body 6 and a flange 23 connected to valve needle 2 by a weld 22 displaces valve needle 2 and valve closing body 3 upward in FIG. 1 back into the closed position of fuel injector 1.

Fuel injector 1 according to the present invention is characterized by an extremely compact design. In the area of actuator 13, the fuel line passes through tubular actuator 13 concentrically with longitudinal axis 24. Therefore, it is not necessary to integrate the fuel line into housing bodies 5 and 6 as is customary in the related art, which thus yields a more compact design on the whole.

The actuating force exerted by tubular actuator 13 is relatively lower than in the case of an actuator having ceramic plates without a central bore, but the fuel pressures occurring with fuel injectors for direct injection of fuel into the combustion chamber of an internal combustion engine having spark ignition with mixture compression, in particular direct gasoline injectors, are lower than those occurring with fuel injectors for self-igniting internal combustion engines, e.g., diesel injectors. Accordingly, the required actuating force is comparatively lower, so that the actuating force exerted by tubular actuator 13 is completely sufficient at least for this preferred application.

Fuel in fuel injector 1 is advantageously used as the hydraulic medium for step-up device 20. This has the advantage that a special hydraulic medium such as hydraulic oil is not needed and cannot contaminate the fuel. Hydraulic medium escaping due to leakage losses can be resupplied automatically. In this embodiment, fuel is resupplied in a quasi-static manner through a guide gap 26 between valve needle 2 and first housing body 5. However, guide gap 26 is designed with such narrow dimensions that little or no hydraulic medium in step-up chamber 21 can escape through guide gap 26 during operation of fuel injector 1.

Figure 2:
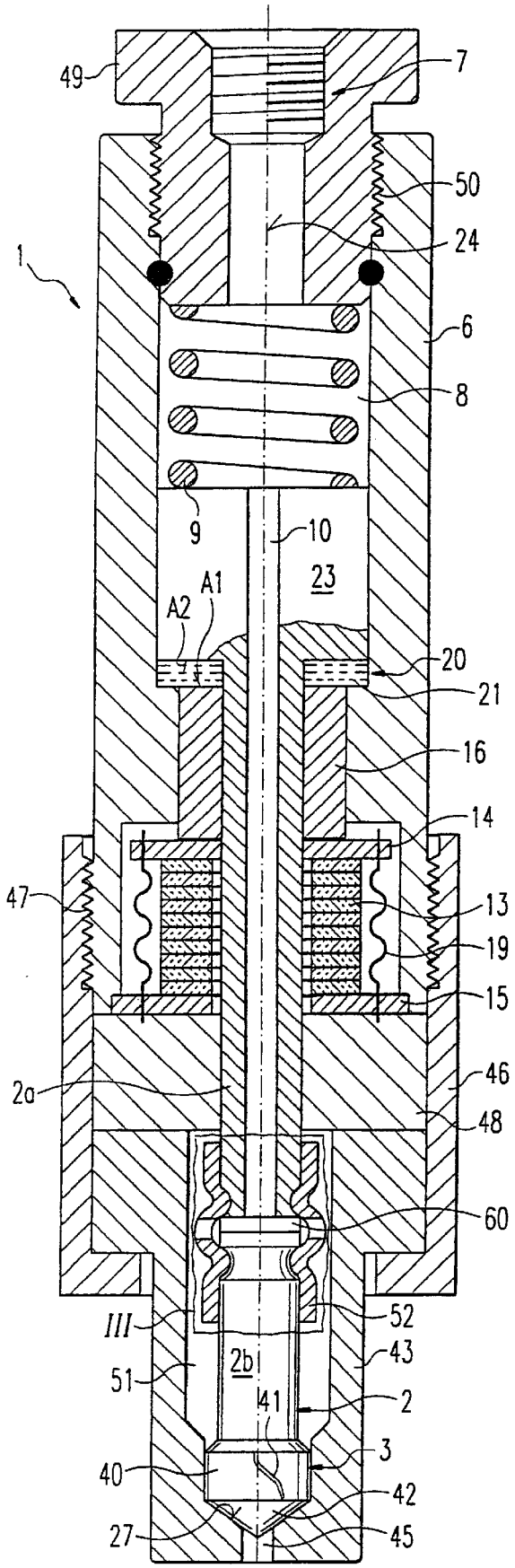
FIG. 2 shows an axial section through a second embodiment of a fuel injector according to the present invention.

FIG. 2 illustrates in a longitudinal section a second embodiment of a fuel injector 1 according to the present invention. In contrast with the embodiment shown in FIG. 1, the embodiment in FIG. 2 is an inward opening fuel injector 1. Elements described previously are labeled with the same reference notation to facilitate assignment and eliminate repetitive description.

Again in this embodiment, valve needle 2 is composed of two parts, a valve needle section 2*a* on the inlet end and a valve needle section 2*b* on the spray end. In this embodiment, valve closing body 3 is molded in one piece with valve needle section 2*b* on the spray end. Valve closing body 3 has a cylindrical section 40 having at least one swirl groove 41 to provide better peripheral distribution of fuel. Cylindrical section 40 is followed in the direction of flow by a conical section 42 of valve closing body 3 working together with a valve seat face 27 formed on a nozzle body 43 to form a sealing seat. When fuel injector 1 is operated, valve closing body 3 is lifted upward and away from valve seat face 27 in FIG. 2, clearing a spray opening 45. Nozzle body 43 is secured against a washer 48 by a lock nut 46 that is screwed to housing body 6 by a thread 47.

Fuel is supplied over a fuel inlet connection 7 provided in an inlet section 49. Fuel flows further into chamber 8 which accommodates restoring spring 9 for valve needle 2. Restoring spring 9 is secured between inlet section 49 which can be screwed into housing body 6 by a thread 50 and a flange 23 which is fixedly connected to valve needle 2, applying a prestress to valve needle 2 and valve closing body 3 against valve seat face 27 in the closing direction of fuel injector 1. Again in this embodiment, valve needle 2 has a longitudinal opening 10 forming a section of the fuel line. Fuel flows through radial bores 60 into a recess 51 in nozzle body 43 and through the minimum of one swirl groove 41 toward the sealing seat.

Also in the embodiment illustrated in FIG. 2, actuator 13 has a tubular design and is secured by a prestress element 19 between a first flange 14 and a second flange 15. When actuator 13 receives an electric voltage, it expands and displaces a step-up plunger 16, upward in FIG. 2 in the direction of fuel inlet connection 7. Therefore, hydraulic medium in step-up chamber 21 of a hydraulic step-up device 20 is displaced, displacing flange 23 and thus valve needle 2 upward in FIG. 2, so that valve closing body 3 is lifted away from valve seat face 27, clearing spray opening 45.

After the electric voltage acting on actuator 13 is turned off, the latter contracts again, i.e., is compressed by prestress element 19 surrounding actuator 13, and valve needle 2 is pushed downward in FIG. 2 by restoring spring 9 until valve closing body 3 is again in contact with valve seat face 27. It should be emphasized that very short operating times can be achieved in both opening and closing due to fuel injector 1 designed according to the present invention.

Fuel injector 1 illustrated in FIG. 2 is assembled by first preassembling all the parts held by housing body 6. Finally, valve needle section 2*b* on the spray end is connected to valve needle section 2*a* on the inlet end by a coupling piece 52 to be described in greater detail below. Then nozzle body 43 is attached and secured using lock nut 46.

Figure 3:
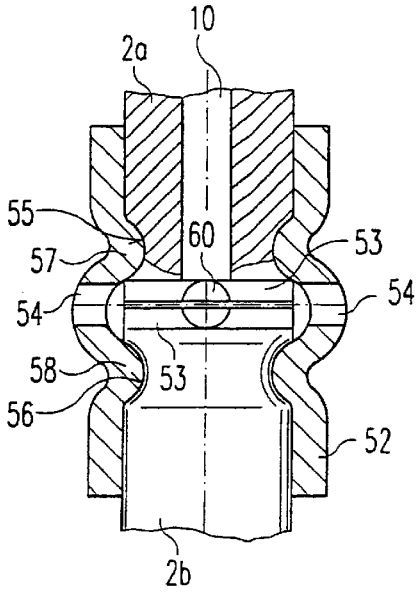
FIG. 3 shows detail III in FIG. 2.

FIG. 3 shows an enlarged diagram of the connection of valve needle section 2*a* on the inlet end to valve needle section 2*b* on the spray end. FIG. 3 shows detail III from FIG. 2.

As described previously, valve needle section 2*a* on the inlet end has an axial longitudinal opening 10 which opens outward through radial bores 60. As can be seen better in FIG. 3, radial bores 60 open into grooves 63 provided in the boundary area between two valve needle sections 2*a* and 2*b* to guarantee a better radial distribution of fuel. Radial bores 54 pass through coupling piece 52, so that fuel ultimately enters recess 51 in nozzle body 43.

For connecting the two valve needle sections 2*a* and 2*b*, valve needle section 2*a* on the inlet end has a first groove 55, while valve needle section 2*b* on the spray end has a second groove 56, each provided on the outer periphery. Coupling piece 52 has projections 57 and 58 extending inward so they engage in grooves 55 and 56. This forms a catch connection between two valve needle sections 2*a* and 2*b*, permitting easy assembly of fuel injector 1.

The present invention is not limited to the embodiments illustrated here. The concept of the fuel line passing centrally through tubular actuator 13 can also be implemented with a plurality of fuel injectors having different designs. Instead of piezoelectric actuator 13, a magnetostrictive actuator may also be used.

What is claimed is:

1. A fuel injector, comprising:

one of a piezoelectric actuator and a magnetostrictive actuator that includes a tubular shape;

a valve needle including an axial longitudinal opening and passing through the one of the piezoelectric actuator and the magnetostrictive actuator;

a valve seat surface;

a valve closing body that is operable by the one of the piezoelectric actuator and the magnetostrictive actuator via the valve needle and works together with the valve seat surface to form a sealing seat;

a fuel inlet connection; and a fuel line leading from the fuel inlet connection to the sealing seat, the valve needle forming a section of the fuel line that is surrounded by the one of the piezoelectric actuator and the magnetostrictive actuator in at least one section, wherein:

the valve needle includes a first valve needle section arranged on an inlet end and a second valve needle section on a spray end that is one of connected to the valve closing body and formed as one piece with the valve closing body, only the first valve needle section extends through the one of the piezoelectric actuator and the magnetostrictive actuator, and a connection of the first valve needle section and the second valve needle section is located downstream from a flow passage through the one of the piezoelectric actuator and the magnetostrictive actuator.

2. The fuel injector according to claim 1, wherein:

the fuel injector is for a fuel injection system in an internal combustion engine.

3. The fuel injector according to claim 1, wherein:

the first valve needle section and the second valve needle section are joined by a weld.

4. The fuel injector according to claim 1, further comprising:

a prestress element surrounding the one of the piezoelectric actuator and the magnetostrictive actuator.

5. The fuel injector according to claim 1, wherein the longitudinal opening of the valve needle extends axially only over a partial section of the second valve needle section.

6. The fuel injector according to claim 1, further comprising a step-up plunger configured to be acted upon by the one of the piezoelectric actuator and the magnetostrictive actuator; wherein the step-up plunger includes a plurality of radial bores around a circumference of the step-up plunger.

7. A fuel injector, comprising:

one of a piezoelectric actuator and a magnetostrictive actuator that includes a tubular shape;

a valve needle including an axial longitudinal opening and passing through the one of the piezoelectric actuator and the magnetostrictive actuator;

a valve seat surface;

a valve closing body that is operable by the one of the piezoelectric actuator and the magnetostrictive actuator via the valve needle and works together with the valve seat surface to form a sealing seat;

a fuel inlet connection;

a fuel line leading from the fuel inlet connection to the sealing seat, the valve needle forming a section of the fuel line that is surrounded by the one of the piezoelectric actuator and the magnetostrictive actuator in at least one section, wherein:

the valve needle includes a first valve needle section arranged on an inlet end and a second valve needle section on a spray end that is one of connected to the valve closing body and formed as one piece with the valve closing body, only the first valve needle section extends through the one of the piezoelectric actuator and the magnetostrictive actuator, and a connection of the first valve needle section and the second valve needle section is located downstream from a flow passage through the one of the piezoelectric actuator and the magnetostrictive actuator; and a restoring spring, wherein:

the first valve needle section includes a flange on which is supported the restoring spring.

8. A fuel injector, comprising:

one of a piezoelectric actuator and a magnetostrictive actuator that includes a tubular shape;

a valve needle including an axial longitudinal opening and passing through the one of the piezoelectric actuator and the magnetostrictive actuator;

a valve seat surface;

a valve closing body that is operable by the one of the piezoelectric actuator and the magnetostrictive actuator via the valve needle and works together with the valve seat surface to form a sealing seat;

a fuel inlet connection;

a fuel line leading from the fuel inlet connection to the sealing seat, the valve needle forming a section of the fuel line that is surrounded by the one of the piezoelectric actuator and the magnetostrictive actuator in at least one section, wherein:

the valve needle includes a first valve needle section arranged on an inlet end and a second valve needle section on a spray end that is one of connected to the valve closing body and formed as one piece with the valve closing body, only the first valve needle section extends through the one of the piezoelectric actuator and the magnetostrictive actuator, and a connection of the first valve needle section and the second valve needle section is located downstream from a flow passage through the one of the piezoelectric actuator and the magnetostrictive actuator; and a coupling piece arranged between the first valve needle section and the second valve needle section, wherein:

the coupling piece includes a first catch projection engaging in a groove on the first valve needle section, and the coupling piece includes a second catch projection engaging in a groove on the second valve needle section.

9. A fuel injector, comprising:

one of a piezoelectric actuator and a magnetostrictive actuator that includes a tubular shape;

a valve needle including an axial longitudinal opening and passing through the one of the piezoelectric actuator and the magnetostrictive actuator;

a valve seat surface;

a valve closing body that is operable by the one of the piezoelectric actuator and the magnetostrictive actuator via the valve needle and works together with the valve seat surface to form a sealing seat;

a fuel inlet connection;

a fuel line leading from the fuel inlet connection to the sealing seat, the valve needle forming a section of the fuel line that is surrounded by the one of the piezoelectric actuator and the magnetostrictive actuator in at least one section, wherein:

the valve needle includes a first valve needle section arranged on an inlet end and a second valve needle section on a spray end that is one of connected to the valve closing body and formed as one piece with the valve closing body, only the first valve needle section extends through the one of the piezoelectric actuator and the magnetostrictive actuator, and a connection of the first valve needle section and the second valve needle section is located downstream from a flow passage through the one of the piezoelectric actuator and the magnetostrictive actuator;

a step-up plunger; and a hydraulic step-up device arranged between the valve needle and the one of the piezoelectric actuator and the magnetostrictive actuator, wherein:

the hydraulic step-up device is acted upon by the one of the piezoelectric actuator and the magnetostrictive actuator by way of the step-up plunger.

10. The fuel injector according to claim 9, wherein:

the hydraulic step-up device includes a hydraulic medium that is connected to the step-up plunger over a first face of the step-up plunger and to the valve needle over a second face of the valve needle that is smaller than the first face.

11. The fuel injector according to claim 10, wherein:

the hydraulic medium includes a fuel carried in the fuel line.

12. The fuel injector according to claim 9, wherein:

the hydraulic step-up device is below the one of the piezoelectric actuator and the magnetostrictive actuator and below the connection of the first valve needle section and the second valve needle section.

13. The fuel injector according to claim 9, wherein:

the hydraulic step-up device is above the one of the piezoelectric actuator and the magnetostrictive actuator and above the connection of the first valve needle section and the second valve needle section.

* * * * *